US006422286B1

(12) United States Patent
Österberg

(10) Patent No.: US 6,422,286 B1
(45) Date of Patent: Jul. 23, 2002

(54) SIGN FOR CONSECUTIVE, REPEATED PRESENTATION OF A SERIES OF IMAGES

(75) Inventor: Jonas Olof Österberg, Odengatan (SE)

(73) Assignee: Prisma World Sign AB, Malmo (SE)

( * ) Notice: Subject to any disclaimer, the term of this patent is extended or adjusted under 35 U.S.C. 154(b) by 0 days.

(21) Appl. No.: 09/482,762

(22) Filed: Jan. 13, 2000

(30) Foreign Application Priority Data

Jan. 19, 1999 (SE) ..... 9900135

(51) Int. Cl.[7] ..... E04F 10/06
(52) U.S. Cl. ..... 160/23.1; 160/241; 40/471
(58) Field of Search ..... 160/23.1, 24, 241; 40/471, 518, 522, 117; 359/461; 248/694

(56) References Cited

U.S. PATENT DOCUMENTS

| | | | | | |
|---|---|---|---|---|---|
| 4,638,580 | A | * | 1/1987 | Giannetti | 40/503 |
| 4,753,025 | A | | 6/1988 | Wennstrom | 40/505 |
| 5,161,421 | A | * | 11/1992 | Stigsson | 40/505 |
| 5,296,964 | A | * | 3/1994 | Shopp | 359/443 |
| 5,333,663 | A | * | 8/1994 | Eger | 160/22 |
| 5,696,494 | A | | 12/1997 | Chen | 340/815.4 |
| 5,815,971 | A | | 10/1998 | Rothe et al. | 40/718 |
| 5,979,093 | A | * | 11/1999 | Harruff et al. | 40/471 |
| 6,029,381 | A | * | 2/2000 | Aleo et al. | 40/471 |
| 6,038,800 | A | * | 3/2000 | Seidel | 40/517 |
| 6,111,694 | A | * | 8/2000 | Shopp | 359/461 |
| 6,295,882 | B1 | * | 10/2001 | Osterberg | 40/505 |

FOREIGN PATENT DOCUMENTS

| | | |
|---|---|---|
| AT | 402121 | 2/1997 |
| CH | 455142 | 6/1988 |
| EP | 0202469 | 11/1989 |
| EP | 0440453 | 8/1991 |

* cited by examiner

*Primary Examiner*—Leslie A. Braun
*Assistant Examiner*—Gwendolyn Baxter
(74) *Attorney, Agent, or Firm*—Tarolli, Sundheim, Covell, Tummino & Szabo L.L.P.

(57) ABSTRACT

A sign (1) for mounting on an underlayer (P) and for consecutive, repeated presentation of a series of images. The sign (1) comprises at least two elongated display members (4). Each display member (4) has a plurality of sides for displaying images. The sign also comprises a respective drive member (6) for rotating each display member (4) and a frame portion for supporting the display members (4). The frame portion comprises at least one first element (7) for mounting to the underlayer (P) and at least two second elements (8) that are connectable to the first element (7). A display member (4) is rotatably supported on a first side of each second element (8). The drive member (6) for each display member (4) is mounted on a second side of each second element (8). The second side of each second element (8) is opposite the first side of each second element (8).

34 Claims, 7 Drawing Sheets

1
3
4
5
VI
VI
III
III
2

SIGN FOR CONSECUTIVE, REPEATED PRESENTATION OF A SERIES OF IMAGES

FIELD OF THE INVENTION

The present invention relates to a frame profile for a mounting frame for a sign for consecutive, repeated presentation of series of images according to the preamble of claim 1.

BACKGROUND OF THE INVENTION

Signs for consecutive, repeated presentation of series of images are delivered, with mounting frame to the place for the assembly thereof. The assembly of said frame on said place or location is normally carried through such that one first attaches support beams to a base or foundation, normally a house wall or a stand, whereupon the mounting frame of the sign is attached to said support beams so that they give the required support and stability to the mounting frame.

This device and this way of assembly have several drawbacks. One drawback is that the frame of often voluminous, which is a problem during long-distance transports. Another drawback is that the mounting frame often must be machined for enabling assembly thereof and this machining can go wrong because skilled personnel is often lacking at the place for assembly. A third drawback is that the support beams for economic reasons can not be delivered along with the signs during long-distance deliveries. This means that the support beams must be obtained locally, after delivery of the sign, which often is a troublesome extra work. When the support beams have been obtained, they must usually be machined for adaptation to the mounting frame. This machining as well as the subsequent mounting of the mounting frame on the support beams, can go wrong because of said lack of skilled labour.

SUMMARY OF THE INVENTION

The object of the present invention is to provide a frame profile for the mounting frame, at which frame profile said drawbacks are eliminated. This is arrived at according to the invention by providing the frame profile with the characterizing features of primarily subsequent claim 1.

Since the frame profile exhibits said characterizing features, several essential advantages are obtained of which the following should be mentioned:

1) since the frame profile consists of two different profile elements which can be given various desired lengths, the size of these profile elements can be less and therefore, they are easier to manufacture, transport and assemble;
2) the separate profile elements are easier to assemble on the place on which the sign shall be mounted, particularly as said second profile elements can be delivered complete with all drive elements belonging thereto; the construction becomes easier to maintain and restore;
3) since the frame profile consists of two different profile elements which cooperate to a self-supporting construction with optimum use of the material for the profile elements, the required stability is obtained, despite saving of material, for withstanding the loads which can be applied thereon by weight and wind, which means that the extra support beams previously necessary can be dispensed with.

BRIEF DESCRIPTION OF THE DRAWINGS

The invention will be further described below with reference to the accompanying drawings, in which.

DETAILED DESCRIPTION OF THE INVENTION

Figure 1:
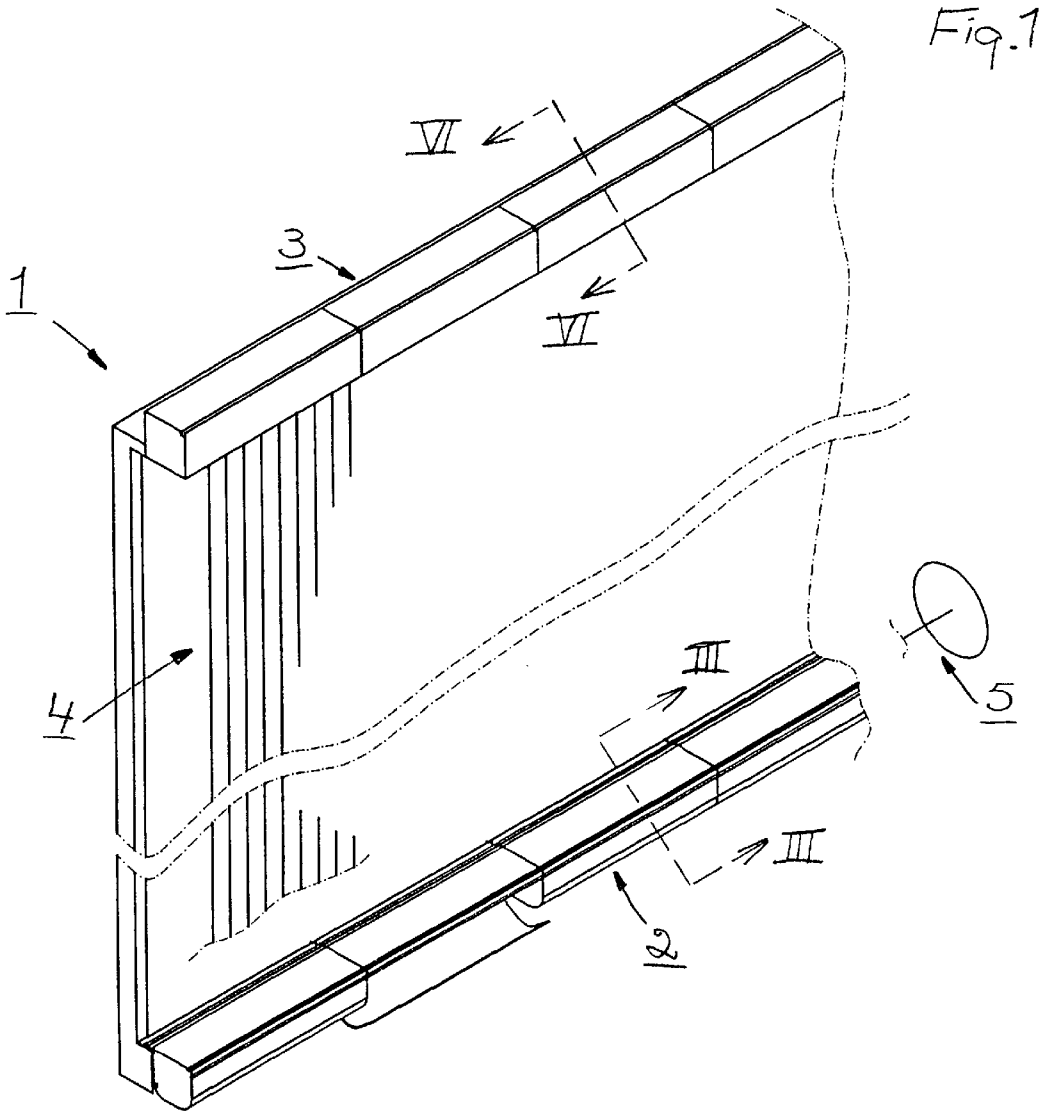
FIG. 1 is a perspective view of a sign for consecutive, repeated presentation of series of images and with a frame profile according to the invention.

The sign 1 for consecutive, repeated presentation of series of images illustrated in the drawings comprises a mounting frame including a lower and an upper frame profile 2 and 3 respectively. A number of elongate display members 4 are provided on said frame profiles 2, 3, said elongate display members 4 having a triangular cross section. The elongate display members 4 are rotatably mounted relative to the frame profiles 2, 3 and a driving device 5 with drive members 6 is provided to operate or drive the elongate display members 4 such that they rotate for change of images.

The driving device 5 and its function for operating the elongate display members 4 is previously known from e.g. U.S. Pat. No. 5,161,421 or EP 0 202 469 and is therefore, not further described here.

The sign 1 according to FIG. 1 also comprises vertical frame profiles, but these are also well known and not described in detail.

The lower frame profile 2 comprises first profile elements 7 for mounting of the frame profile on a location or underlayer P on which the sign 1 is adapted to be mounted, and second profile elements 8, provided with the drive members 6 of the driving device 5, for connection with said first profile elements 7.

In order to facilitate manufacture, transport, assembly and mounting of the frame profile 2, one or more first profile elements 7 are included therein, and so are two or more second profile elements 8 which can be connected with said first profile elements 7, wherein each second profile element 8 includes drive members 6 of said driving device 5 and wherein each second profile element 8 with associated drive members 6 is separately connectable with at least one first profile element 7. Drive members 6 in adjacent second profile elements 8 are, after connection of the second profile elements 8 with said first profile element or elements 7, connectable with each other for transfer of driving movements between the drive members 6 of the various second profile elements 8. The abovementioned design of the frame profile in a plurality of short profile-element modules, permits multiple production of the profile elements and members forming part thereof irrespective of the final size of the sign and the order stock.

In order to facilitate disassembly for maintenance and repairs, each second profile element 8 with associated drive members 6 is in a corresponding manner separately disconnectable from said first profile element or elements 7.

Said first profile elements 7, if more than one is used, as well as said second profile elements 8 are respectively mounted in alignment until the frame profile 2 is complete in its entire length. Each second profile element 8 is also connectable with two first profile elements 7 such that the first profile elements 7 can be connected to each other by means of the second profile elements 8. Such a design is suitable e.g. when said first profile elements 7 are short and located at a distance from each other, whereby this construction also gets the required stability.

The first profile elements 7 in a frame profile 2 have, for production purposes, preferably the same length and profile. The second profile elements 8 have, for production purposes and for being able to easier construct frame profiles with the most common number of elongate display members 4, a first or a second length with the same profile. Said first profile element or elements 7 however, preferably have a substantially greater length than said second profile elements 8. Thus, each first profile element 7 may e.g. be about 4 m and each second profile element 8 have a length of about 1 m. The length of the first profile element 7 is hereby an integer multiple of the length of each second profile element 8. When second profile elements 8 with said first as well a s said second length are used, the length of the first profile element 7 or the aggregated length of the first profile elements 7 must naturally be equal to the sum of the aggregated length of second profile elements 8 with said first length and of the aggregated length of second profile elements 8 having said second length.

As stated above, the elongate display members 4 are rotatably mounted in the lower as well as the upper frame profile 2 and 3 respectively. In the embodiment shown, wherein the second profile elements 8 are adapted to permit mounting of said display members 4 at the lower frame profile 2, said display members are mounted on said second profile elements 8 on the opposite side thereof as the drive members 6 of the driving device 5.

For connection of said first and said second profile elements 7 and 8 respectively, in predetermined positions relative to each other, the profile elements may be provided with suitable means, i.e. be designed in a suitable manner and/or have means of a type suitable for the purpose. Preferably however, said means are of such character that said first and second profile elements 7 and 8 respectively, can be connected with each other without prior machining thereof in any way. Assembly and disassembly is thereby facilitated, as is of course the manufacture of the profile elements 7, 8.

According to a preferred embodiment of the invention, said means comprise at least one first coupling portion 9 on the first profile element 7 and at least one first coupling portion 10 on the second profile element 8 for connection of said profile elements with each other. In order to simplify assembly and disassembly of the second profile elements 8 for e.g. maintenance and repairs, said first coupling portions 9, 10 are preferably designed such that they only due to their shape permit said connection of the profile elements with each other.

In order to facilitate for the first profile element 7 to support the second profile element 8 and further lock it onto the first profile element 7 for obtaining a self-supporting construction, said means also comprise at least one second coupling portion 11 on the first profile element 7 and at least one second coupling portion 12 on the second profile element 8 for connection of said profile elements 7, 8 with at least one support and lock element 13. Thus, support and lock elements 13 extending between the profile elements 7, 8 allow transfer of loads on the second profile element 8 from said profile element to the first profile element 7 and see to that the second profile element 8 is effectively locked onto the first profile element 7 at least one further spot. As with said first coupling portion 9, 10, said second coupling portions 11, 12 on the profile elements 7, 8 are also, for easier assembly and disassembly, preferably designed such that they, thanks to their shape only, permit said connection of the profile elements with said support and lock elements 13.

The profile elements 7, 8 are after connection with each other located so relative to each other that said second profile element 8 protrudes from said first profile element 7, e.g. horizontally as in the drawings. Existing support and lock elements 13 are thereby found substantially within an area which on at least two sides is limited by said second profile element 8 and by a part 15*b*, 21*b*, 22*b* of said first profile element 7 extending preferably perpendicular to, i.e. in the drawings substantially vertically down from said second profile element, as well as, in the most simple embodiment, by such imaginary lines (not shown), preferably parallel to said second profile element 8 and to said part 15*b*, 21*b*, 22*b* of said first profile element 7 respectively, that a four-side structure is defined. The drive members 6 in each second profile element 8 are hereby found in the same limited area as said support and lock elements 13. According to a preferred embodiment of the invention which means a material reduction and easier assembly, said support and lock elements 13 are formed by mounting members 14 for said drive members 6. The mounting members 14 are preferably also used as coupling members for connection of drive members 6 in adjacent second profile elements 8. The mounting members 14 may also be pivotally mounted in one of the coupling portions 11, 12 therefor. The mounting members 14 or other support and lock elements 13 are of course also preferably designed to permit said shape-depending connection with the profile elements, but may of course also be connected therewith in another suitable manner, e.g. attached by screwing in or at the coupling portions 11 and 12 respectively, of the profile elements 7, 8.

Figure 2:
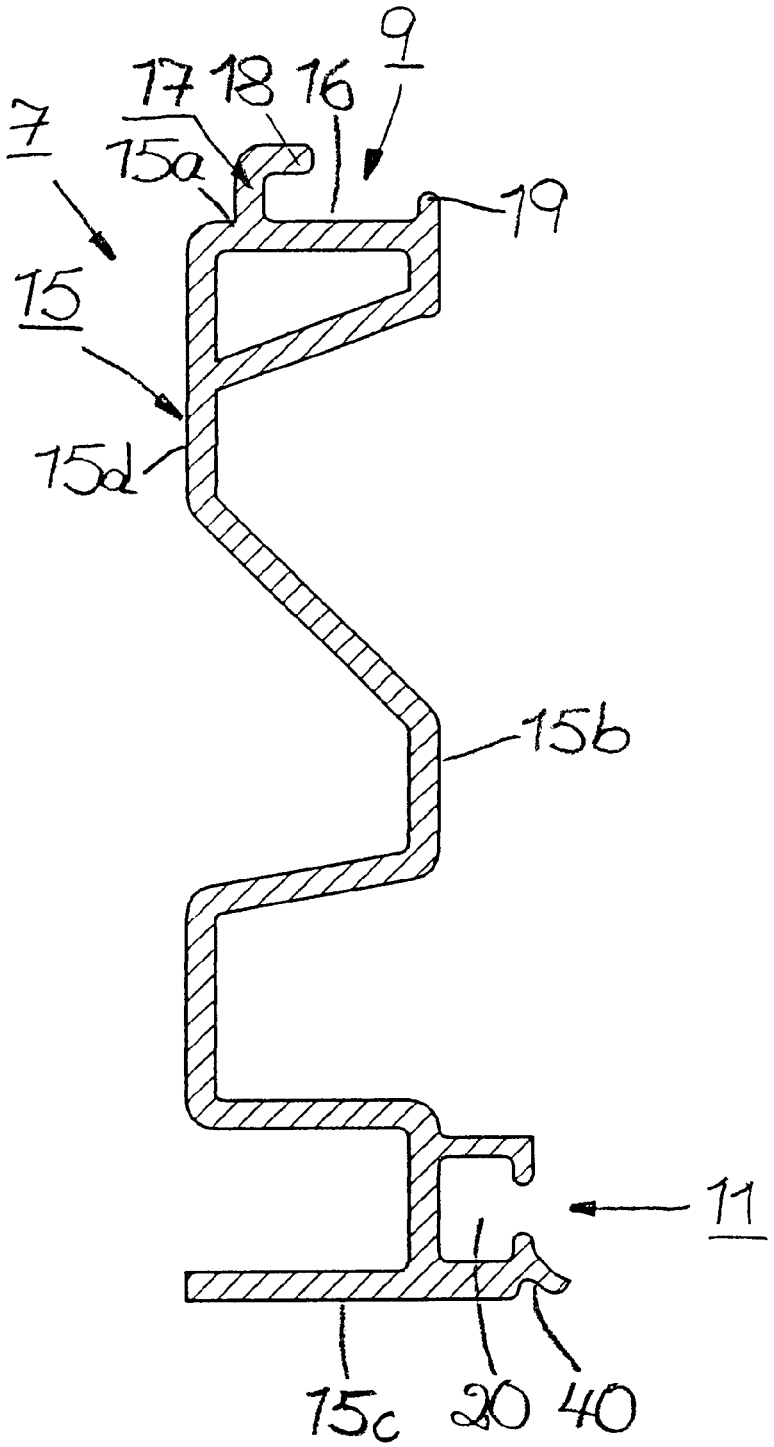
FIG. 2 is a section through a first embodiment of a first profile element forming part of the frame profile.

In FIG. 2 there is shown a suitable embodiment of the first profile element 7 for mounting preferably on a wall. Said first profile element 7 is for this purpose formed as an elongate rail 15 with a substantially four-side cross section. In the illustrated embodiment the rail 15 consists of a profile which has been bent and reinforced to said substantially four-side cross section. One of the coupling portions 9 or 11 is located on one of the sides 15*a*–15*d* of the rail 15 and the other coupling portion 11 or 9 on a side extending substantially perpendicular to the side with said one coupling portion. The rail 15 has a substantially rectangular cross section, whereby one of the coupling portions 9 or 11 is found on one of the short sides 15*a* or 15*c* of the rectangle and the other coupling portion 11 or 9 on one of the long sides 15*b* or 15*d*. The rail 15 is mounted horizontally in a manner known per se with one of the long sides 15*d* against an underlayer, i.e. preferably a wall. The mounting is carried through such that said first coupling portion 9 on the first profile element 7, i.e. here the rail 15, is found on the upper short side 15*a* of the rail after mounting, while the second coupling portion 11 of the first profile element 7 is found, after mounting, on the outer long side 15*b* of the rail facing away from the underlayer.

The first coupling portion 9 on the short side 15*a* of the rail 15 is in order to facilitate assembly and disassembly of one or more second profile elements 8 thereon, preferably designed such that, as stated above, no machining is required. The first coupling portion 9 may thereby, as is apparent from FIG. 2, be shaped as an upwardly open groove 16 which on one side, situated after mounting closest to the underlayer for said mounting, is limited by a hook portion 17 with an end 18 facing away from the underlayer, and on the other side by an upwardly extending protuberance 19. The first coupling portion 9 is in the illustrated embodiment found on the short side 15*a* of the rail 15 close to the long side 15*b* with the second coupling portion 11.

The second coupling portion 11 on the long side 15*b* of the rail 15 is also designed as a groove 20 which after mounting of the rail is facing outwards from the underlayer. The second coupling portion 11 is found on the long side 15*b* of the rail 15 preferably as far away as possible from the first coupling portion 9.

Figure 3:
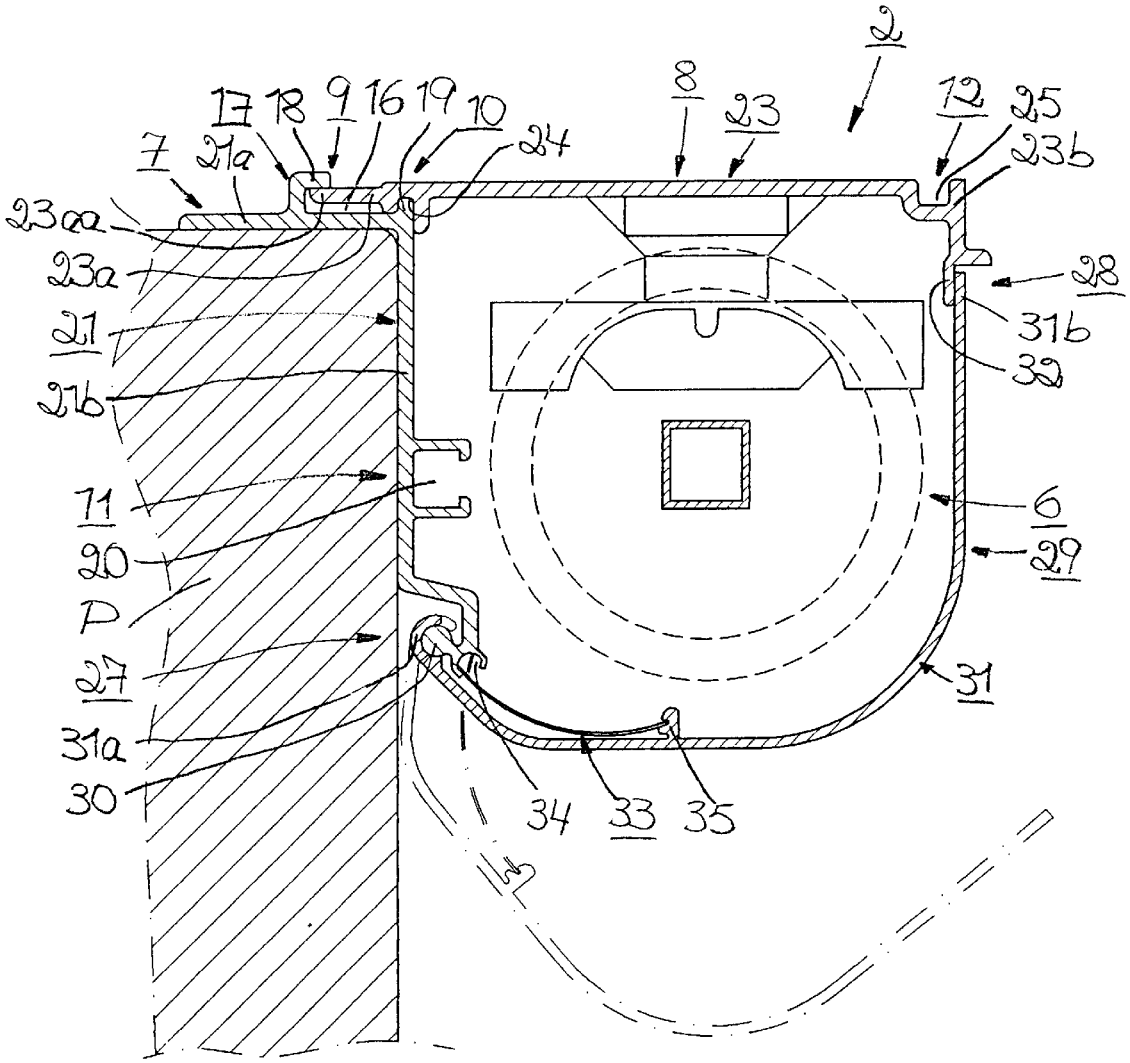
FIG. 3 is a section III—III through the lower frame profile of FIG. 1.

In the embodiment according to FIG. 3, preferably adapted for mounting on an underlayer P in the form of an existing steel stand or niche in a building, etc., the first profile element 7 is designed as an elongate angle piece 21 with two in cross section substantially perpendicular shanks 21*a* and 21*b* and with a coupling portion 9 and 11 respectively, on each shank. The angle piece 21 preferably has such shape that one of the shanks 21*b* thereof is longer in cross section than the other shank 21*a* on the angle piece.

As with the rail 15 the angle piece 21 is mounted preferably horizontally on the underlayer P, e.g. exteriorly around a corner on a beam of a stand or similar, such that one of the shanks 21*a*, the shorter one in cross section, extends horizontally and the other, in cross section longer shank 21*b*, in vertical direction. The first coupling portion 9 on the first profile element 7, i.e. the angle piece 21, is thus, equivalent to the rail embodiment, provided or designed on the shorter, horizontal shank 21*a*, while the second coupling portion 11 on the first profile element is found on the longer, vertical shank 21*b*.

Both coupling portions 9, 11 on the angle piece 21 are designed substantially as the coupling portions on the rail 15 and their location is also almost identical.

Figure 6:
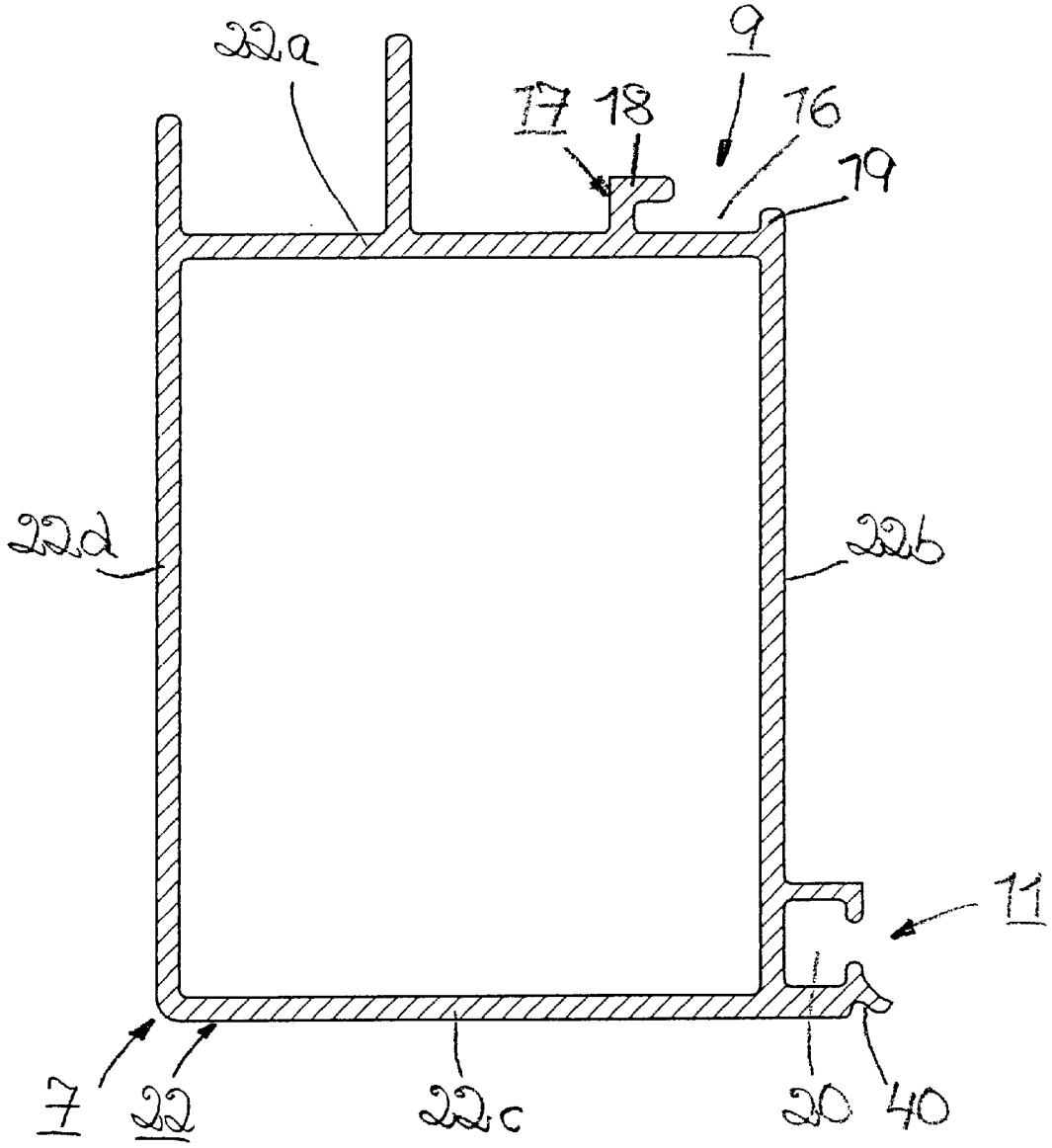
FIG. 6 is a section through another embodiment of a first profile element forming part of the frame profile.

In FIG. 6 there is shown another embodiment of the first profile element 7. The first profile element 7 is here designed as an elongate support beam 22 with an endless, preferably four-side cross section. One of the coupling portions 9 or 11 is found on one of the beam sides 22*a*–22*d* and the other coupling portion 11 or 9 on a side extending substantially perpendicular to the side with said one coupling portion. The beam 22 preferably has a rectangular cross section with one of the coupling portions 9 or 11 on one of the short sides 22*a* or 22*c* of the rectangle and the other coupling portion 11 or 9 on one of the long sides 22*b* or 22*d*. As with the rail 15 and the angle piece 21, the beam 22 is mounted preferably horizontally with one long side 22*d* against an underlayer, preferably a wall. Mounting is carried through such that said first coupling portion 9 on the first profile element 7, here the beam 22, is designed or provided on the upper short side 22*a*, after mounting, of the beam, while said second coupling portion 11 on the first profile element 7 is provided or formed on the outer long side 22*b* of the beam 22 which, after mounting, if facing away from the underlayer.

Both coupling portions 9, 11 on the beam 22 are designed and located substantially as the coupling portions on the rail 15.

Figure 5:
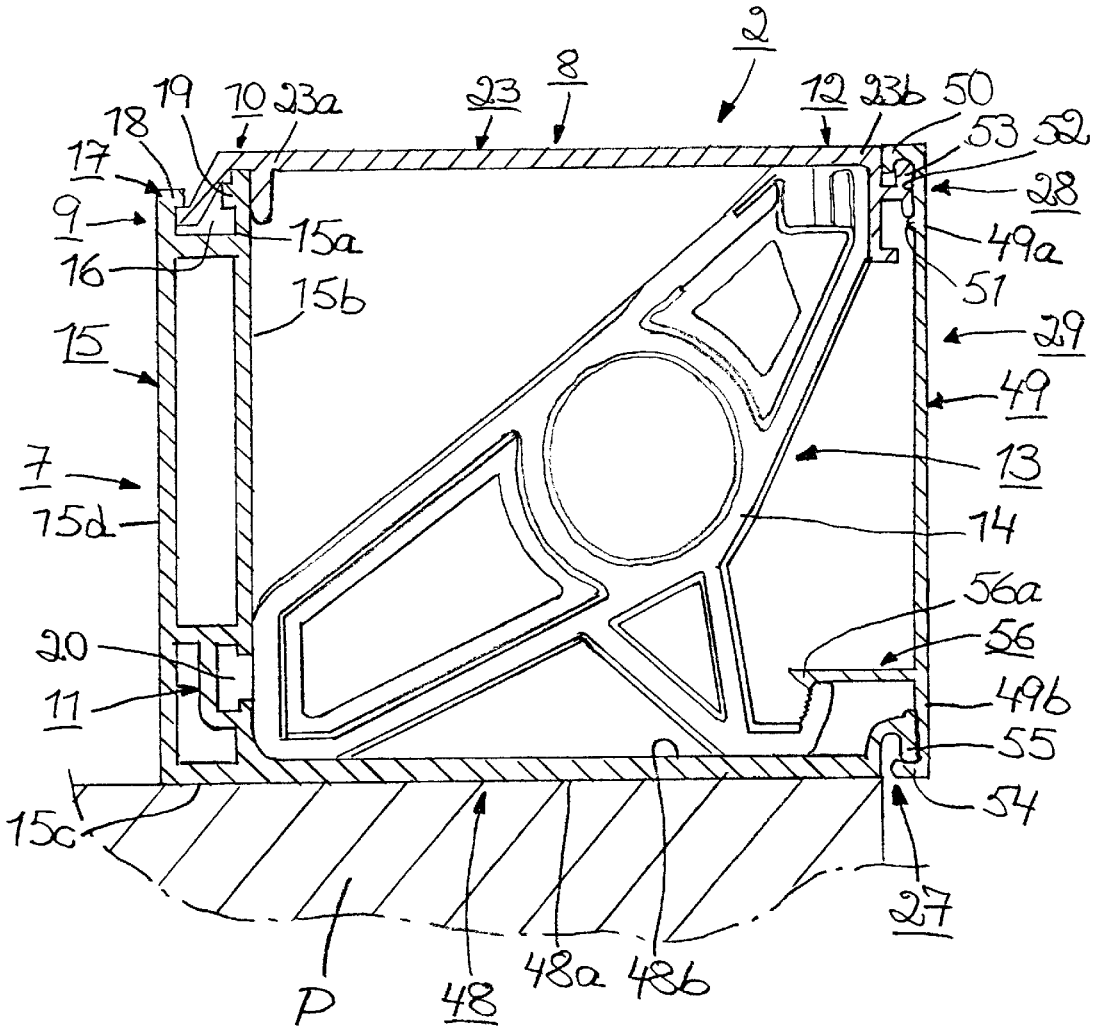
FIG. 5 is a section through a third embodiment of the frame profile according to the invention.

FIG. 5 illustrates yet another embodiment of the first profile element 7 shaped primarily as the rail 15, although it also may be designed substantially as the angle piece 21 or the beam 22 with their first and second coupling portions 9, 11. Here, said first profile element 7 further comprises an engagement portion 48 which protrudes substantially perpendicular from the side provided with said second coupling portion 11, i.e. the long side 15*b*, and which has an engagement surface 48*a* through which said first profile element 7 can be placed on an underlayer P for the frame profile 2. This embodiment is particularly useful when the frame profile 2 is to be mounted resting on top of a horizontal surface, but may of course, as the other embodiments, be used also in many other applications. The engagement portion 48 protrudes from the side 15*b* with said second coupling portion 11 at a distance from the side with the first coupling portion 9, i.e. the short side 15*a*, preferably at the opposite short side 15*c* of the rail 15 and most preferably in alignment therewith such that a smooth, planar surface 15*c*, 48*a* is obtained for engaging the underlayer P. After assembly with a second profile element 8, said profile element and said engagement portion 48 extend substantially in parallel with each other. Furthermore, the engagement portion 48 may be provided with or designed to include a third coupling portion (not shown) of any suitable type or shape for, preferably in dependence of the shape of said coupling portion, connection of the first profile element 7 with said support and lock elements 13 in order to further facilitate for said first profile element to support, along with said support and lock elements, said second profile element 8 and lock it onto said first profile element. Alternatively, as in FIG. 5, the surface 48*b* opposite to said engagement surface 48*a* may simply provide a support for the support and lock elements 13, which then are correspondingly designed to rest upon said surface 48*b*.

Figure 4:
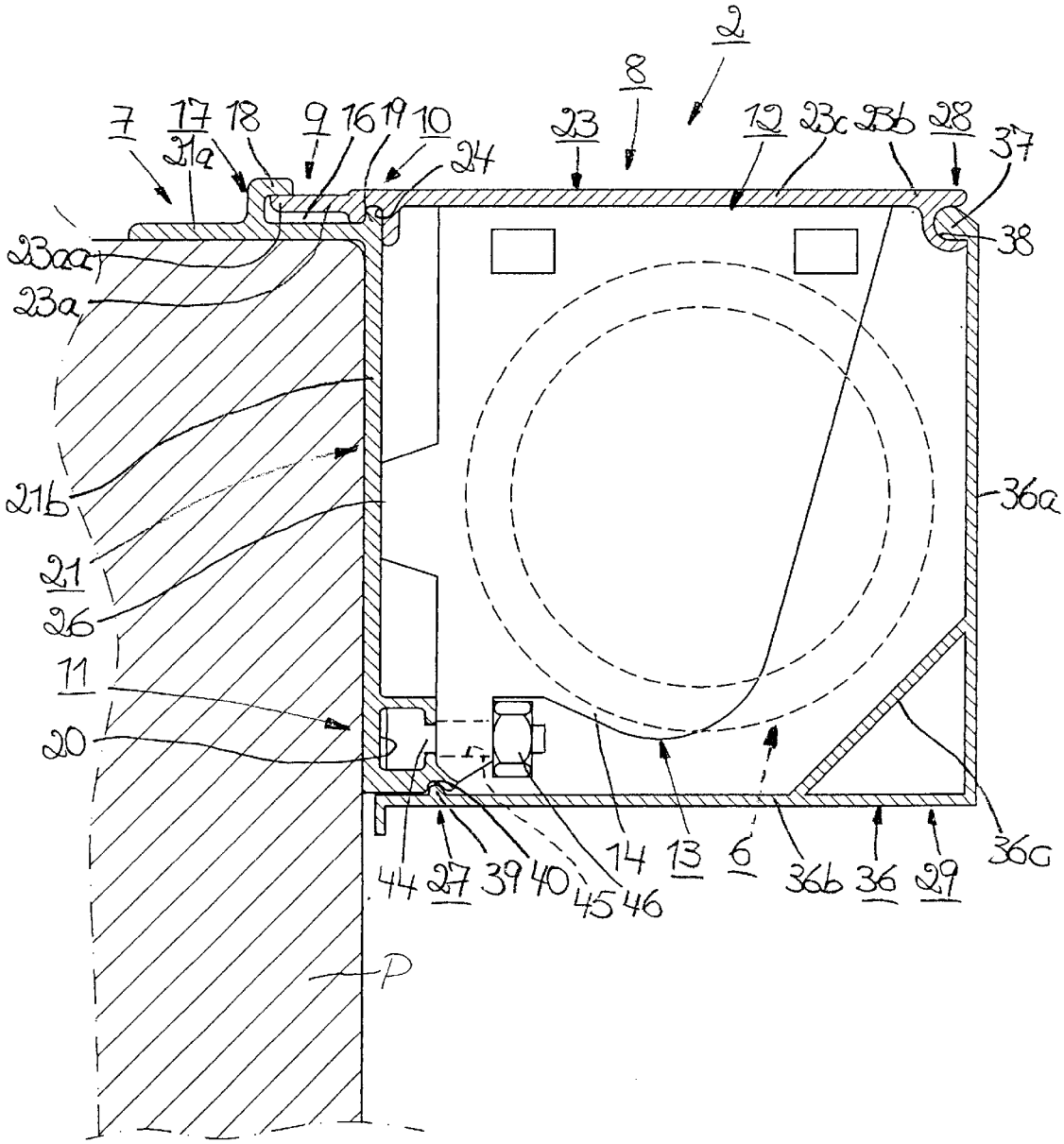
FIG. 4 is a section through a second embodiment of the frame profile according to the invention.

Again with reference to FIG. 3 as well as to FIG. 4 and FIG. 5, it is apparent from said figures that the second profile element 8 is designed substantially as an elongate plate 23 with, in the transverse direction of the plate, a coupling portion 10 and 12 respectively, at or adjacent each end 23*a*, 23*b* thereof. Said plate 23 extends in the illustrated embodiments substantially horizontally also in the longitudinal direction after connection thereof with the first profile element 7.

The first coupling portion 10 on said second profile element 8 is thus, in the embodiment of FIG. 3, after connection with the first profile element 7, provided at the end 23*a* of the plate 23 closest to the underlayer P upon which said first profile element is mounted. This first coupling portion 10 is here designed such that the outermost portion 23*aa* of said end 23*a* of the plate 23 protrudes into the groove 16 and to the hook portion 17 for engagement from below of the end 18 of said portion 17. In the coupling portion 10 there is also included a downwardly directed recess 24 which fits over and snaps onto the protuberance 19 during connection of the profile elements 7, 8 with each other after said portion 23*aa* of the end 23*a* of the plate 23 has been inserted into the groove 16 to said hook portion.

Said second coupling portion 12 for the support and lock element (not shown) on the second profile element 8, comprises in the embodiment of FIG. 3 an upwardly open groove 25 which, alternatively, may open downwards or located on the underside of the plate 23, as the drive members 6 associated with said second profile element.

In the embodiment of FIG. 4, the second coupling portion 12 of the second profile element 8 is defined by some part or parts of the portion 23*c* of the plate 23 situated between the ends 23*a*, 23*b* of said plate in the transverse direction thereof. The mounting members 14, functioning as support and lock members for the drive members 6 in the second profile element 8, are from below attached to said portion 23c. The mounting members 14 are in FIG. 4 fixedly secured in the coupling portion 11 therefor or are only lying against said coupling portion. The mounting members 14 may thus be attached to the coupling portion 11 on the first profile element 7 not only by suitable shape-depending adaptation of these parts/portions to each other, but also e.g. as in FIG. 4 by means of a threaded bolt 44 which is provided in the coupling portion 11 and which protrudes therefrom, through a hole 45 down below in each mounting member and out of the mounting member with its free end, on which a nut 46 is threaded. The mounting members 14 may also engage the first profile element 7 at other spots (see at 26, FIG. 4 and at 48*b*, FIG. 5) and get support therefrom for in turn supporting the second profile element 8.

According to the invention, the first profile element 7 and/or the second profile element 8 may have at least one further coupling portion 27 and 28 respectively, for connection thereto of a cover element 29, such that said cover element can be located in a position wherein it defines a space for the drive members 6 and the mounting members 14 therefor associated with the second profile element 8, between the profile elements 7, 8 and the cover element 29. These further coupling portions 27, 28 may, as said first, second and third coupling portions on the profile elements, be designed in any suitable manner for the application. A preferred embodiment giving the required protection of the drive members 6 and yet easy access thereto when necessary, is shown in FIG. 3 and FIG. 4 as well as in FIG. 5, and means that the first or the second profile element 7 or 8 has at least one further coupling portion 27 or 28 for pivotable connection thereto of a cover element 29 which is suitably designed for pivoting. Thus, the cover element 29 can be brought to engage or be attached to the profile element 8 or 7 to which it is not pivotally connected and thereby take a position wherein it defines a space for said drive members 6 between the profile elements 7, 8 and the cover element (shown with unbroken lines in FIG. 3), and be pivoted from said position to a position exposing said drive members 6 (shown with broken lines in FIG. 3).

In the embodiment of FIG. 3, said further coupling portion 27 of the first profile element 7 consists of, as is apparent from the figure, a member 30 having a substantially ball-shaped cross section and around which a bent end 31*a* adapted thereto of the cover element 29, said element having the shape of a case-like member 31 with a curved cross section, is provided. The second profile element 8 has in FIG. 3 only one engagement portion 32 which is engaged with prestress by the opposite end 31*b* of the case-like member 31 such that the cover element 29 is kept closed for protection of the drive members 6. This prestress towards the stated engagement position (unbroken lines, FIG. 3) as well as towards the position of exposure (broken lines, FIG. 3) is obtained by means of a spring means 33 which in stretched condition is located in the space for the drive members 6, extending between a groove 34 at the coupling portion 27 (ball-shaped member 30) of the first profile element 7 (angle piece 21) and an attachment 35 for the spring means 33 on the inside of the cover element 29 (case-like member 31). From said engagement position the spring means 33 may, by an appropriate design thereof, during opening of the cover element 29 for access to said space with the drive members 6, be brought beyond a shift position and instead take a position prestressing or urging the cover element 29 towards said position of exposure, whereby the spring force of the spring means 33 also may be used for giving an operator free hands for maintenance, repair or exchange of drive members 6 in the space within the cover element.

At the alternative embodiment of FIG. 4, the cover element 29 consists of an angle piece 36 with two perpendicular, substantially equally long shanks 36*a* and 36*b* and a reinforcement 36*c* in the corner between the shanks. An almost square space for the drive members 6 in the second profile element 8 is thus defined between the first and second profile elements 7, 8 (angle piece 21 and the plate 23 respectively) and the cover element 29 (angle piece 36). The vertical shank 36*a* of the angle piece 36 has at its free end, after assembly, an inwardly directed ball-shaped member 37 which is received in an outwardly directed groove 38 adapted thereto in the end 23*b* of the plate 23. Thus, the groove 38 defines said further coupling portion 28 of the second profile element 8 for the cover element 29 (angle piece 36). The horizontal shank 36*b* of the angle piece 36 has at its end a protuberance 39 which, with the angle piece in closed position, defining the space for the drive members 6 and protecting said drive members, fits or snaps into a groove 40 on the underside of the portion defining one side of the groove 20 (the second coupling portion 11) on the first profile element 7. Thus, the groove 40 can be regarded as said further coupling portion 27 of the first profile element 7 for the cover element 29. The ball joint 37, 38 permits pivotal movement of the angle piece 36 between said closed position and the position of exposure for access to said drive members 6.

At the further alternative embodiment of FIG. 5, the cover element 29 merely consists of an elongate plate 49 having at one end 49*a* thereof, seen in the transverse direction of said plate, a hook portion 50 and a protuberance 51 defining a groove 52 therebetween for engagement, preferably permitting pivotal movement of said plate 49, by receiving therein a larger protuberance 53 on the second profile element 8, said larger protuberance defining said further coupling portion 28 on said second profile element for the cover element 29. At the opposite end 49*b* of the plate 49, said plate has another hook portion 54 which, when the cover element 29 is in closed position, fits or snaps over a protuberance 55 at the free end of the engagement portion 48 of the first profile element 7. Contrary to the cover elements 29 described above in connection with FIG. 3 and FIG. 4, the cover element of FIG. 5 is also designed for connection with at least one support and lock element 13 as described above. In the embodiment of FIG. 5, the cover element 29 is for this purpose provided with a flange 56 with a hook end 56*a* which engages a correspondingly designed part of each support and lock element 13.

As alternative to the embodiments described above with coupling portions 11, 12 on the profile elements 7, 8 for separate support and lock elements 13, said first profile elements 7 and/or second profile elements 8 may, according to the invention, be designed directly with support and lock elements 41 in order to, as with the support and lock elements 13, see to that said first profile elements can support said second profile elements and lock them to said first profile elements. Such an embodiment is illustrated in FIG. 7.

Figure 7:
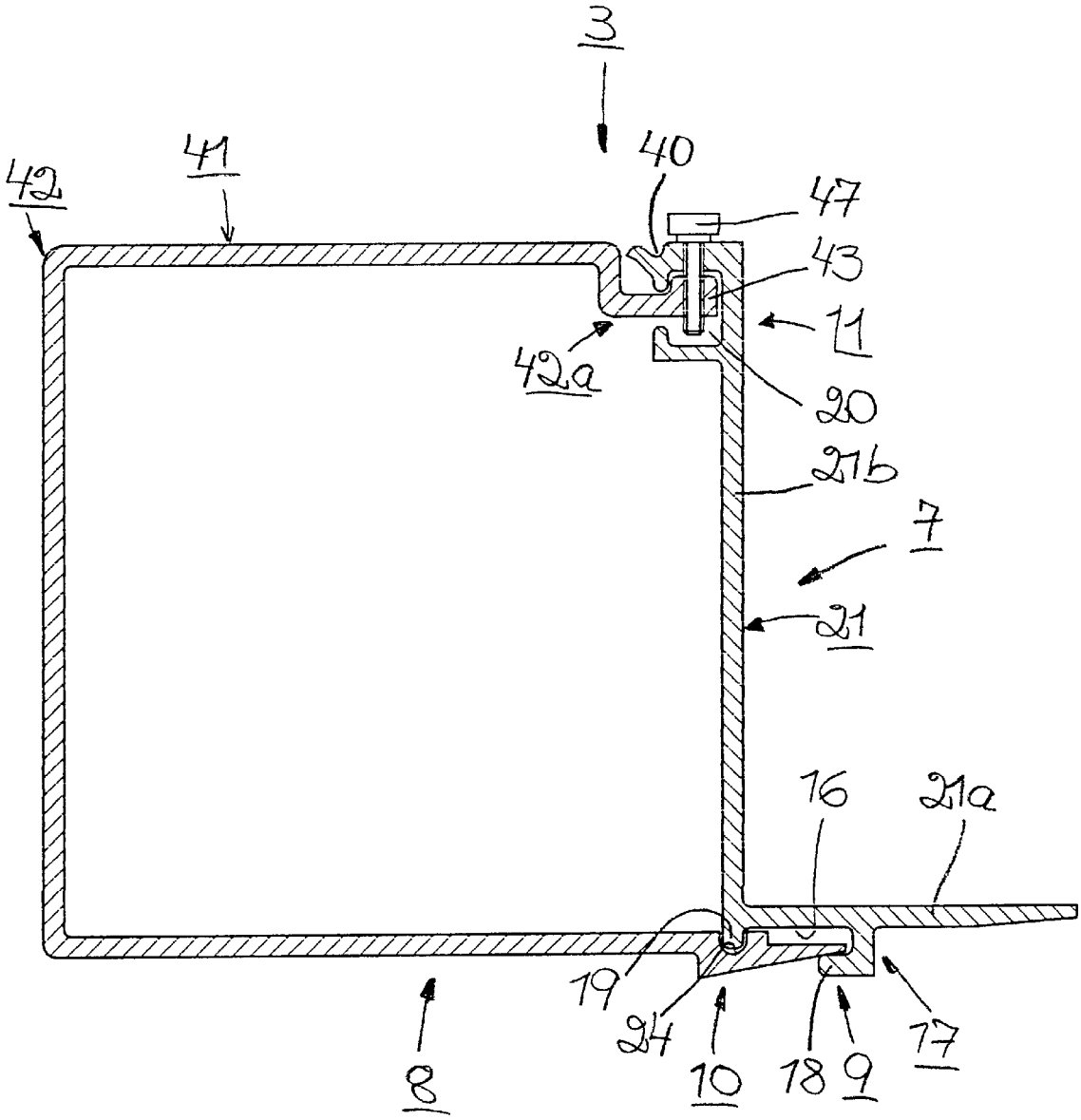
FIG. 7 is a section VII—VII through an embodiment of the upper frame profile of FIG. 1.

The frame profile of FIG. 7 corresponds with the upper frame profile 3 of FIG. 1 and thus, lacks a driving device, but can of course also be used as a lower frame profile with driving device as e.g. the embodiments of FIG. 3 and 4 or alternatively, as these, be used for mounting at the top of the mounting frame of a driving device for operating the elongate display members in a sign for consecutive, repeated presentation of series of images.

Said support and lock element 41 at said alternative embodiment of the frame profile according to the invention is defined preferably by at least one shank on said first profile element 7 or on said second profile element 8, as in FIG. 7, or on said first as well as on said second profile element, said shank or shanks being angled such that said second profile element alone or the profile elements together define, in cross section, preferably a four-side space for said drive members, which, at least on said latter case, is facilitated if the profile elements as the profile elements described above, extend at an angle relative to each other with at least parts thereof. In the embodiment of FIG. 7 it is thus, as indicated above, the second profile element 8 that is designed with a shank 42 in angle. The free end 42*a* of the shank 42 in angle is inserted and hooked onto (hook portion 43), screwed onto (screw 47) or in any other way provided in a coupling portion corresponding to said second coupling portion 11 on the first profile element 7, the groove 20 in the illustrated embodiment.

Similar to the embodiment of FIG. 5, a shank in angle (not shown) on said first profile element 7 may define an engagement surface through which said first profile element can be located on an underlayer, preferably resting op top thereof, for the frame profile.

Since the drive members that should be accessible for maintenance and repair lack in the embodiment of FIG. 7, cover elements as such are also lacking; the function thereof however, can be taken over by the support and lock elements 41 if drive members are present. For the sake of simplicity, these should then be able to be swung aside, i.e. said shank 42 or shanks or parts thereof should be pivotally designed on the respective profile element 7 and/or 8 for, after pivoting from a support and lock position, access to the drive members 6 in the space therefor.

Of course, the support and lock elements 41 may, as the support and lock elements 13, be designed in many other ways than as in FIG. 7 and still obtain the intended function for the support and lock elements.

The upper frame profile 3 for the mounting frame for the sign 1 may of course, in contrast to FIG. 1, also comprise profile elements with the same profile as the profile elements of the lower frame profile 2.

The connection of the profile elements 7, 8 with each other and with the support and lock elements 13 and 41 respectively, is facilitated if the coupling portions 9, 10 and 11, 12 respectively, therefor extend along substantially the entire length of the profile elements. Even the coupling portions 27, 28 for eventual cover elements 29 may extend along substantially the entire length of the profile elements 7, 8.

The above description of the frame profile according to the invention has almost exclusively concerned embodiments wherein the frame profile is placed as a lower frame profile for the mounting frame to the sign 1 for consecutive, repeated presentation of series of images. It is of course so, which also to a certain extent has been indicated above, that all the frame profile embodiments described above, with as well as without driving device, can be used as an upper frame profile for the mounting frame for the sign, after turning of the frame profile 180° in a vertical plane, but also as a lateral frame profile after turning thereof 90° in a vertical plane.

It is obvious to a skilled person that beyond what appears from the above description, the present invention may vary within the scope of the subsequent claims without departing from the idea and spirit of the invention. Thus, the number, shape, size and location of the profile elements, the coupling portions thereon, the support and lock elements, the cover elements, etc., may vary in accordance with requirements and desires. Similarly, drive shafts for the transfer of driving force may form part of said drive members 6, but instead of such drive shafts, driving force may be transferred by other means, e.g. gear belts. Except for said coupling portions or other means for connection of the profile elements with each other and with the support and lock elements and cover elements respectively, the profile elements are preferably beforehand also provided with means, e.g. holes, for facilitating or permitting mounting of the frame profile 2, 3 on the intended underlayer P and for mounting drive members 6, elongate display members 4, etc. in the frame profile respectively.

What is claimed is:

1. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first element (7) has a length that is greater than a length of each of the second elements (8).

2. The sign (1) as defined in claim 1 wherein each second element (8) is separately disconnectable with the first element (7).

3. The sign (1) as defined in claim 1 wherein the second element (8) connects one first element (7) to an adjacent first element (7).

4. The sign (1) as defined in claim 1 wherein multiple first elements (7) are provided and all of the first elements (7) have a uniform length and profile.

5. The sign (1) as defined in claim 1 wherein all of the second elements (8) have a uniform profile and have one of first and second lengths.

6. The sign (1) as defined in claim 1 wherein the length of the first element (7) is an integer multiple of the length of each of the second elements (8).

7. The sign (1) as defined in claim 1 wherein an aggregate length of the at least one first element (7) equals an aggregate length of the at least two second elements (8).

8. The sign (1) as defined in claim 1 wherein the at least two second elements (8) have one of first and second lengths, the at least one first element (7) has a length equal to an aggregated length of the second elements (8).

9. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first and second elements (7 and 8) have means (9–12) for connection of the first and second elements (7 and 8) in predetermined positions relative to each other, the means (9–12) comprises at least one first coupling portion (9) on the first element (7) and at least one first coupling portion (10) on the second element, and wherein the means further comprises at least one second coupling portion (11) on the first element (7) and at least one second coupling portion (12) on the second element (8) for connection of the first and second elements (7 and 8) with at least one support and lock element (13) such that the first element (7) by means of the at least one support and lock element (13) can support the second element (8) and lock the second element (8) to the first element (7).

10. The sign (1) as defined in claim 9 wherein the first and second elements (7 and 8), after connection with each other, are located relative to each other such that the second element (8) protrudes from the first element (7), the at least one support and lock element (13) being located substantially within an area which is limited on at least two sides by the second element (8) and by a part (15*b*, 21*b*, 22*b*) of the first element (7) which extends perpendicular to the second element (8).

11. The sign (1) as defined in claim 10 wherein the drive member (6) of each second element (8) is located within the area, the at least one support and lock element (13) comprising mounting members (14) for the drive members (6).

12. The sign (1) as defined in claim 11 wherein the mounting members (14) are pivotally mounted in one of the coupling portions (11, 12).

13. The sign (1) as defined in claim 11 wherein the mounting members (14) constitute coupling members for connecting drive members (6) of adjacent second elements (8).

14. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first element (7) is formed as an elongated rail (15) with a substantially four-sided cross-section and with a first coupling portion (9 or 11) on a first side and a second coupling portion (11 or 9) on a second side that extends perpendicular to the first side.

15. The sign (1) as defined in claim 14 wherein the rail (15) has a substantially rectangular cross-section with the first coupling portion (9 or 11) on a short side (15*a* or 15*c*) of the rectangle and the second coupling portion (11 or 9) on a long side (15*b* or 15*d*) of the rectangle.

16. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first element (7) is an elongated angle piece (21) with two substantially perpendicular shanks (21*a*, 21*b*) and with a coupling portion (9 or 11) on each shank (21*a* and 21*b*).

17. The sign (1) as defined in claim 16 wherein a first shank (21*b*) of the angle piece (21) is longer, in cross-section, than a second shank (21*a*) of the angle piece (21).

18. The sign (1) as defined in claim 17 wherein the angle piece (21) is mounted horizontally on the underlayer (P) such that the first shank (21*b*) extends vertically and the second shank (21*a*) extends horizontally, the first coupling portion (9) being located on the second shank (21*a*) and the second coupling portion (11) being located on the first shank (21*b*).

19. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first element (7) is an elongated beam (22) having an endless, four-sided cross-section with a first coupling portion (9 or 11) on a first side of the beam (22) and a second coupling portion (11 or 9) on a second side of the beam (22) that extends substantially perpendicular to the first side of the beam (22).

20. The sign (1) as defined in claim 19 wherein the beam (22) has a rectangular cross-section with the first coupling portion (9 or 11) on a short side (22*a* or 22*c*) of the rectangle and the second coupling portion (11 or 9) on a long side (22*b* or 22*d*) of the rectangle.

21. The sign (1) as defined in claim 20 wherein the beam (22) is mounted horizontally with a long side (22*d*) against the underlayer (P), the first coupling portion (9) being formed on an upper short side (22*a*) of the beam (22) and the second coupling portion (11) being formed on an outer long side (22*b*) of the beam (22).

22. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first element (7) further comprises an engagement portion (48) which protrudes substantially perpendicularly from a side (15*b*) provided with a coupling portion (11) and which has an engagement surface (48*a*) through which the first element (7) can be placed on the underlayer (P).

23. The sign (1) as defined in claim 22 wherein the engagement portion (48) protrudes from the side (15*b*) with the coupling portion (11) at a distance from a second side (15*a*) with a second coupling portion (9).

24. The sign (1) as defined in claim 23 wherein, after assembly with the second element (8), the engagement portion (48) protrudes from the side (15*b*) with coupling portion (11) in a direction substantially parallel with the second element (8).

25. The sign (1) as defined in claim 24 wherein the engagement portion (48) has a third coupling portion for connection of the first element (7) with a support and lock element, the support and lock element (13) helping the first element (7) to support the second element (8).

26. The sign (1) as defined in claim 24 wherein the engagement portion (48) enables a support and lock element (13) to facilitate the first element (7) in supporting and locking the second element (8).

27. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein each of the first and second elements (7 and 8) has a coupling portion (27 and 28) for connection of a cover element (29), the cover element (29) defining a space for enclosing the drive member (6) of each second element (8) between the first element (7), the second element (8), and the cover element (29).

28. The sign (1) as defined in claim 27 wherein the cover element (29) is pivotally connected to the coupling portion (27 or 28) of one of the first and second elements (7 and 8) so that the cover element (29) may be pivoted to expose the drive member (6) of each second element (8).

29. The sign (1) as defined in claim 27 wherein the cover element (29) is connectable with at least one support and lock element (13), the at least one support and lock element (13) helping the first element (7) to support the second element-(8) and lock the second element (8) to the first element (7).

30. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein the first and second elements (7 and 8) have means (9–12) for connection of the first and second elements (7 and 8) in predetermined positions relative to each other, the means (9–12) comprises at least one first coupling portion (9) on the first element (7) and at least one first coupling portion (10) on the second element (8), the means further comprising at least one support and lock element (41) which is formed on at least one of the first and second elements (7 and 8) such that the first element (7) by means of the at least one support and lock element (41) can support the second element (8) and lock the second element (8) onto the first element (7).

31. The sign (1) as defined in claim 30 wherein the at least one support and lock element (41) is defined by at least one shank (42) on at least one of the first and second elements (7 and 8), the shank (42) being angled such that the first and second elements (7 and 8) define a space for the drive member (6) of each second element (8).

32. The sign (1) as defined in claim 31 wherein a shank, which is angled, on the first element (7) defines an engagement surface through which said first element (7) can be located on the underlayer (P).

33. The sign (1) as defined in claim 31 wherein the at least one shank (42) is designed for pivoting from a support and lock position to allow access to the drive member (6) of each second element (8) that is located in the space.

34. A sign (1) for mounting on an underlayer (P) and for consecutive, repeated presentation of a series of images, the sign (1) comprising:

at least two elongated display members (4), each display member (4) having a plurality of sides for displaying images;

a respective drive member (6) for rotating each display member (4); and a frame portion for supporting the display members (4), the frame portion comprising at least one first element (7) for mounting to the underlayer (P) and at least two second elements (8) that are connectable to the first element (7), a display member (4) being rotatably supported on a first side of each second element (8), and the drive member (6) for each display member (4) being mounted on a second side of each second element (8), the second side of each second element (8) being opposite the first side of each second element (8);

wherein coupling portions (9–12, 27, 28) of the first and second elements (7 and 8) extend along substantially an entire length of the first and second elements (7 and 8).

* * * * *